US006027398A

United States Patent [19]

Numoto et al.

[11] Patent Number: 6,027,398

[45] Date of Patent: Feb. 22, 2000

[54] WAFER POLISHING APPARATUS

[75] Inventors: Minoru Numoto; Kenji Sakai; Manabu Satoh; Hisashi Terashita, all of Mitaka, Japan

[73] Assignee: Tokyo Seimitsu Co., Ltd., Tokyo, Japan

[21] Appl. No.: 09/131,690

[22] Filed: Aug. 10, 1998

[30] Foreign Application Priority Data

Aug. 11, 1997 [JP] Japan ..... 9-216700

[51] Int. Cl.[7] ..... B24B 5/00; B24B 29/00

[52] U.S. Cl. ..... 451/285; 451/287; 451/288; 451/289; 451/5

[58] Field of Search ..... 451/5, 6, 8, 9, 451/10, 11, 28, 41, 63, 285, 287, 288, 289, 364, 388, 390, 397, 398, 402

[56] References Cited

U.S. PATENT DOCUMENTS

| | | | |
|---|---|---|---|
| 5,584,751 | 12/1996 | Kobayashi et al. | 451/287 |
| 5,738,574 | 4/1998 | Tolles et al. | 451/287 |
| 5,762,539 | 6/1998 | Nakashiba et al. | 451/287 |
| 5,795,215 | 8/1998 | Guthrie et al. | 451/288 |
| 5,803,799 | 9/1998 | Volodarsky et al. | 451/288 |
| 5,879,220 | 3/1999 | Hasegawa et al. | 451/287 |

FOREIGN PATENT DOCUMENTS

| | | |
|---|---|---|
| 0 737 546 | 10/1996 | European Pat. Off. . |
| 8-339979 | 12/1996 | Japan . |
| 9-139366 | 5/1997 | Japan . |
| 10-113862 | 5/1998 | Japan . |
| PCT/US96/07119 | 5/1996 | WIPO . |

*Primary Examiner*—Timothy V. Eley
*Assistant Examiner*—Derris Holt Banks
*Attorney, Agent, or Firm*—Sixbey, Friedman, Leedom & Ferguson; David S. Safran

[57] ABSTRACT

A wafer is polished while it is pressed against a polishing cloth through a pressure air layer, and a polished surface adjustment ring as well as the wafer are pressed against the polishing cloth. The wafer is polished in the state wherein a collapsing position of the polished surface adjustment ring with respect to the polishing cloth is set in such a way that the polishing pressure which is applied from the polishing cloth to the wafer can be constant.

12 Claims, 11 Drawing Sheets

WAFER POLISHING APPARATUS

BACKGROUND OF THE INVENTION

1. Field of the Invention

The present invention relates generally to a wafer polishing apparatus, and more particularly to a wafer polishing apparatus which is used with a chemical mechanical polishing (CMP) method.

2. Description of Related Art

A wafer polishing apparatus disclosed in Japanese Patent Provisional Publication No. 8-339979 is provided with a holding head (a carrier), a polishing pad (a polishing cloth), and a seal member. Liquid supply passages are formed in the holding head, and a pressurized liquid is supplied into a space enclosed by the holding head, a substrate (a wafer) and the seal member, and the pressurized liquid presses the substrate against the polishing pad.

An annular guide member is attached to the holding head of the wafer polishing apparatus. The guide member as well as the substrate are pressed against the polishing pad so as to prevent the substrate from springing out of the holding head due to a centrifugal force.

The wafer polishing apparatus of Japanese Patent Provisional publication No. 8-339979, however, presses the substrate against the polishing pad only with the pressurized liquid. For this reason, the polishing pressure applied from the polishing pad to the substrate centers on the peripheral edge of the substrate, in other words, the polishing pad rises at the peripheral edge of the substrate. Consequently, the peripheral edge is polished more than an the other parts.

SUMMARY OF THE INVENTION

The present invention has been developed in view of the above-described circumstances, and has as its object the provision of a wafer polishing apparatus which makes uniform a polishing pressure, which is applied to a wafer by a polishing cloth, so as to uniformly polish the entire surface of the wafer.

To achieve the above-mentioned object, the present invention is directed to a wafer polishing apparatus which presses a wafer against a rotating polishing cloth to polish the surface of the wafer, the wafer polishing apparatus comprising: a carrier for holding the wafer and pressing the wafer against the polishing cloth; a polished surface adjustment ring which encloses the periphery of the wafer and is pressed against the polishing cloth with the wafer; pressing means for pressing the polished surface adjustment ring against the polishing cloth; position detecting means for detecting a collapsing position of the polished surface adjustment ring with respect to the polishing cloth; control means for controlling the pressure force of the pressing means to set the collapsing position detected by the position detecting means such that a polishing pressure applied to the wafer from the polishing cloth is uniform.

To achieve the above-mentioned object, the present invention is directed to a wafer polishing apparatus which presses a wafer against a rotating polishing cloth to polish the surface of the wafer, the wafer polishing apparatus comprising: a carrier for holding the wafer; first pressing means for pressing the carrier against the polishing cloth; pressure air layer forming means for forming a pressure air layer between the carrier and the wafer and transmitting the pressure force from the first pressing means to the wafer through the pressure air layer; a retainer ring provided outside the carrier and preventing the wafer from springing out of the carrier; a polished surface adjustment ring provided outside the retainer ring and comes into contact the polishing cloth with the wafer; second pressing means for pressing the polished surface adjustment ring against the polishing cloth; position detecting means for detecting a collapsing position of the polished surface adjustment ring with respect to the polishing cloth; control means for controlling the pressure force of the second pressing means to set the collapsing position detected by the position detecting means such that a polishing pressure applied to the wafer from the polishing cloth is uniform.

A wafer polishing apparatus which presses a wafer against a rotating polishing cloth to polish the surface of the wafer, the wafer polishing apparatus comprising: a carrier for holding the wafer; first pressing means for pressing the carrier against the polishing cloth; pressure air layer forming means for forming a pressure air layer between the carrier and the wafer and transmitting the pressure force from the first pressing means to the wafer through the pressure air layer; a retainer ring provided outside the carrier and preventing the wafer from springing out of the carrier; a polished surface adjustment ring provided outside the retainer ring and comes into contact the polishing cloth with the wafer; second pressing means for pressing the polished surface adjustment ring against the polishing cloth; a pressing member provided outside the retainer ring, the pressing member coming into contact with the polishing cloth which was pressed and flattened by the polished surface adjustment ring; position detecting means for detecting a relative displacement of the pressing member and the carrier, and detecting a collapsing position of the polished surface adjustment ring with respect to the polishing cloth according to the relative displacement; control means for controlling the pressure force of the second pressing means to set the collapsing position detected by the position detecting means such that a polishing pressure applied to the wafer from the polishing cloth is uniform.

According to the present invention, the wafer is polished while it is pressed against the polishing cloth by the carrier. At this time, the pressing means pressed the polished surface adjustment ring against the polishing cloth, and the control means controls the pressing means to set the collapsing position of the polished surface adjustment ring with respect to the polishing cloth so that the polishing pressure which is applied to the wafer from the polishing cloth can be uniform. The wafer is polished in this state.

According to the present invention, the pressure air layer forming means forms the pressure air layer between the carrier and the wafer, and the pressure force transmits from the first pressing means to the wafer through the pressure air layer. Thereby, the wafer is polished while it is pressed against the polishing cloth. Even if there are some foreign matters such as polishing dust between the carrier and the wafer, the pressure force can be transmitted uniformly from the first pressing means to the entire surface of the wafer. Thus, the entire surface of the wafer can be polished uniformly.

According to the present invention, there is provided the polished surface adjustment ring which comes into contact with the polishing cloth together with the wafer, and the second pressing means adjusts the pressure force of the polished surface adjustment ring against the polishing cloth. The control means controls the second pressing means to set the collapsing position of the polished surface adjustment ring with respect to the polishing cloth in such a way that the polishing pressure which is applied to the wafer from the polishing cloth can be uniform. The wafer is polished in this state.

According to the present invention, the pressing member which is pressed against the polishing cloth with the wafer is provided with the position detecting means, which detects the relative displacement of the pressing member and the carrier to thereby detect the collapsing position of the polished surface adjustment ring with respect to the polishing cloth. The control means controls the second pressing means to set the collapsing position of the polished surface adjustment ring with respect to the polishing cloth in such a way that the polishing pressure which is applied to the wafer from the polishing cloth can be uniform. The wafer is polished in this state. Since, the polishing pressure which is applied to the wafer from the polishing cloth is uniform, the entire surface of the wafer can be polished uniformly. Since the pressing member is pressed against the polishing cloth flattened by the polished surface adjustment ring, the pressing member is not vibrated by the unevenness of the polishing cloth. The position detecting means attached to the pressing member can correctly detect the collapsing position of the polished surface adjustment ring with respect to the polishing cloth.

According to the present invention, the differential transformer provided with the core and the bobbin is applied as the position detecting means. The differential transformer makes it possible to correctly detect the collapsing position of the polished surface adjustment ring with respect to the polishing cloth.

According to the present invention, the capacity sensor is used for the position detecting means. The capacity sensor makes it possible to correctly detect the collapsing position of the polished surface adjustment ring with respect to the polishing cloth.

According to the present invention, the pressing member is made of material which is difficult to expand thermally, and the contact surface of the pressing member is coated with diamond or is made of ceramic. This prevents the pressing member from expanding thermally during polishing and being polished by the polishing cloth. Thus, the stock removal detecting means attached to the pressing member can correctly detect the collapsing position of the polished surface adjustment ring with respect to the polishing cloth.

According to the present invention, the retainer ring is made of sorter material than the polished surface adjustment ring. The polished surface adjustment ring must be harder than the polishing cloth in order to press and deforms the polishing cloth elastically. If such a hard polished surface adjustment ring is used to prevent the wafer from springing out of the carrier, the wafer may be damaged when the wafer comes into contact with the polished surface adjustment ring. To solve this problem, the retainer ring is made of softer material than the polished surface adjustment ring. Thus, the present invention prevents the wafer from being damaged when the wafer comes into contact with the retainer ring.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be explained in further detail by way of example with reference to the accompanying drawings.

Figure 1:
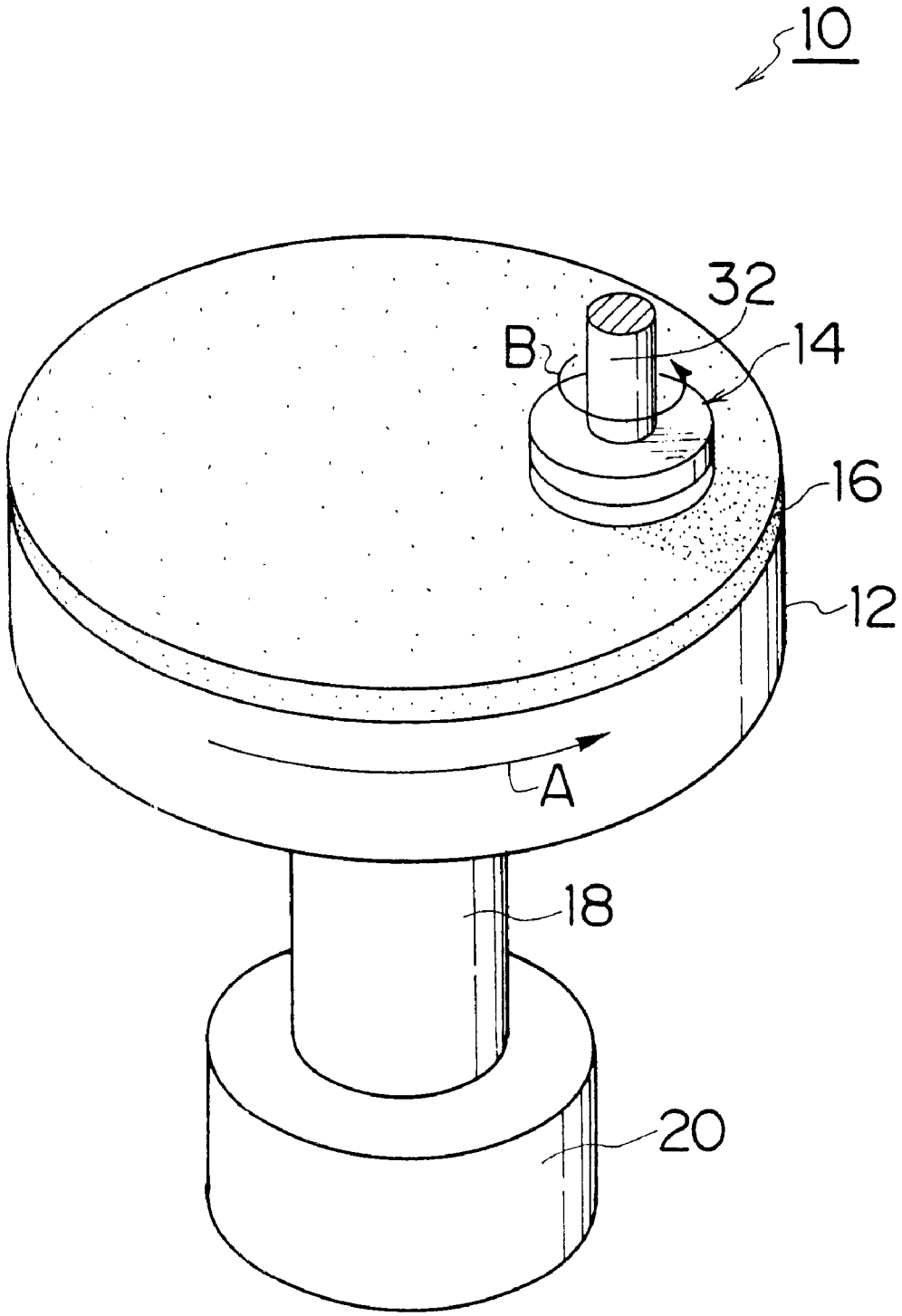
FIG. 1 is a view illustrating the entire structure of the wafer polishing apparatus according to the present invention.

FIG. 1 shows the entire structure of a wafer polishing apparatus according to the present invention.

As shown in FIG. 1, the wafer polishing apparatus 10 is provided with a turn table 12 and a wafer holding head 14. The turn table 12 is disc-shaped, and a polishing cloth 16 is attached on the top of the turn table 12. A spindle 18 connects to the bottom of the turn table 12 and an output shaft (not shown) of a motor 20. Driving the motor 20 rotates the turn table 12 in the direction indicated by an arrow A, and slurry is supplied onto the polishing cloth 16 of the rotating turn table 12 through a nozzle (not shown). A lifting apparatus (not shown) is capable of moving the wafer holding head 14 vertically. The wafer holding head 14 is moved up when a wafer subject for polishing is set in the wafer holding head 14, and the wafer holding head 14 is pressed against the polishing cloth 16 when the wafer is polished.

Figure 2:
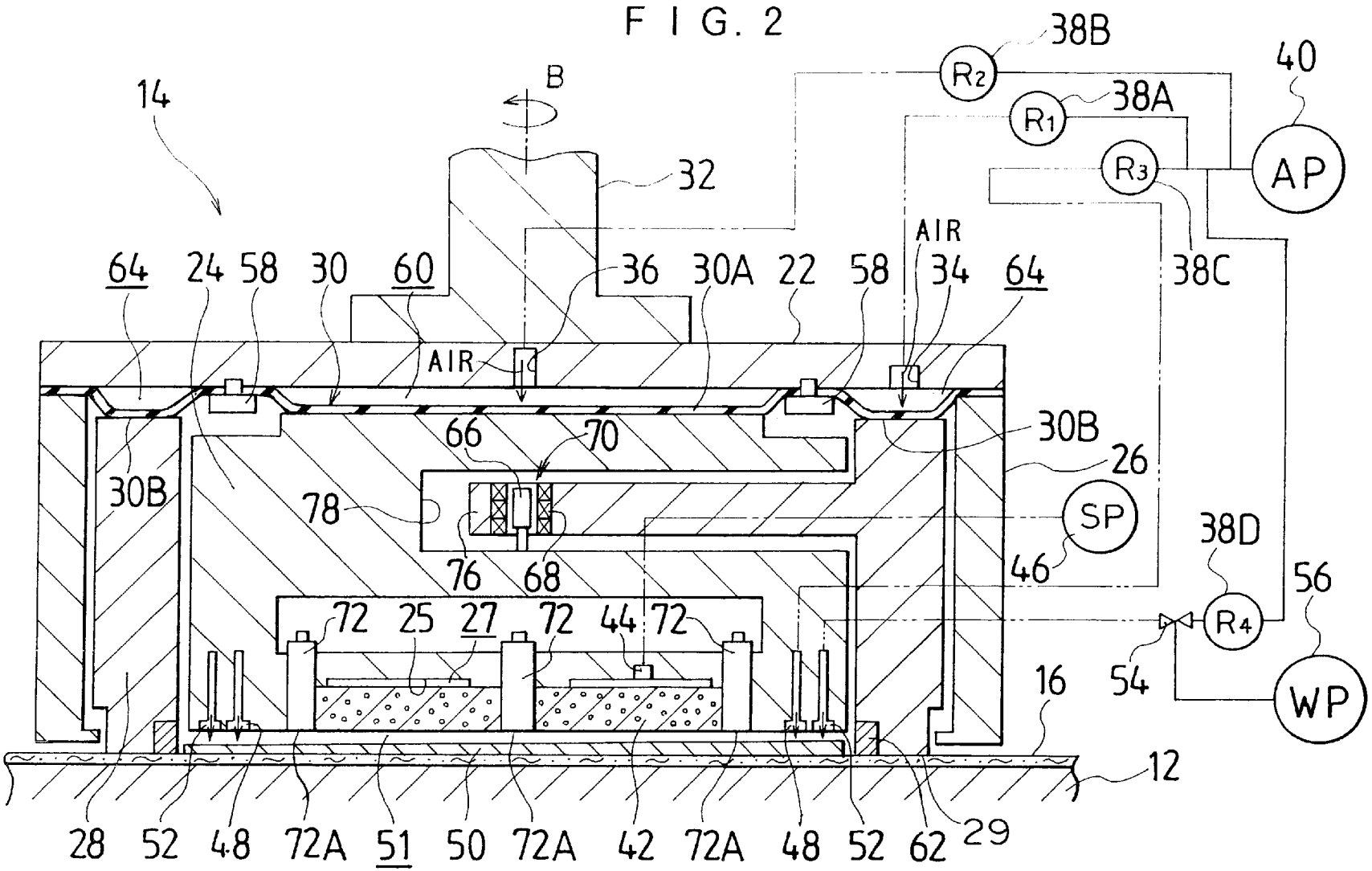
FIG. 2 is a longitudinal sectional view illustrating the first embodiment of the wafer holding head applied to the wafer polishing apparatus in FIG. 1.

FIG. 2 is a longitudinal sectional view of the wafer holding head 14. The wafer holding head 14 is comprised mainly of a head body 22, a carrier 24, a guide ring 26, a polished surface adjustment ring 28, and a rubber sheet 30. The head body 22 is disc-shaped, and a motor (not shown) connected to a rotary shaft 32 rotates the head body 22 in the direction indicated by an arrow B. Air supply passages 34, 36 are formed in the head body 22. The air supply passage 34 extends to the outside of the wafer holding head 14 as indicated by long and short alternate lines in FIG. 2. The air supply passage 34 connects to an air pump (AP) 40 via a regulator (R) 38A. The air supply passage 36 connects to the air pump 40 via a regulator 38B.

The carrier 24 is shaped substantially like a column, and it is coaxially arranged below the head body 22. A concave 25 is formed at the bottom of the carrier 24, and the concave 25 contains a permeable porous board 42. An air chamber 27 is formed over the porous board 42, and the air chamber 27 connects with an air suction passage 44 formed in the carrier 24. The air suction passage 44 extends to the outside of the wafer holding head 14 as indicated by long and short alternate lines in FIG. 2, and it connects to a suction pump (SP) 46. Driving the suction pump 46 causes the porous board 42 to absorb the wafer 50 to the bottom thereof. The porous board 42 has a number of vent holes therein, and it is, for example, a sintered body of a ceramic material.

A number of air supply passages 48, 48 are formed in the bottom of the carrier 24 (FIG. 2 shows only two air supply passages). The air supply passages 48 extend to the outside of the wafer holding head 14 as indicated by long and short alternate lines in FIG. 2, and the air supply passages 48 connect to the air pump 40 via a regulator 38C. When the air pump 40 is driven, the compressed air is supplied from the air pump 40 to an air chamber 51 between the porous board 42 and the wafer 50 through the air supply passages 48. This forms a pressure air layer in the air chamber 51, and, therefore, the pressure force of the carrier 24 is transmitted to the wafer 50 through the pressure air layer. The wafer 50 is pressed against the polishing cloth 16 by the pressure force transmitted through the pressure air layer.

The wafer holding head 14 controls the pressure force against the carrier 24 to move the carrier 24 vertically, and controls the polishing pressure of the wafer 50 (the force for pressing the wafer 50 against the polishing cloth 16). For this reason, the control of the polishing pressure is easier than the control of the polishing pressure of the wafer 50 by directly controlling the pressure of the pressure air layer. In other words, the wafer holding head 14 is able to control the polishing pressure of the wafer 50 by controlling the vertical position of the carrier 24. The air, which is jetted through the air supply passages 48, is discharged through a vent (not shown) which is formed in the polished surface adjustment ring 28.

A number of air/water supply passages 52 (FIG. 2 shows only two of them) are formed in the carrier 24, and their jetting holes are formed in the bottom of the carrier 24. The air/water supply passages 52 extend to the outside of the wafer holding head 14 as indicated by long and short alternate lines in FIG. 2, and each passage 52 is divided into two branches with use of a valve 54. One branch connects to the air pump 40 through a regulator 38D, and the other branch connects to a water pump (WP) 56. If the valve 54 opens the branch at the air pump 40 side and closes the branch at the water pump 56 side, the compressed air is supplied from the air pump 40 to the air chamber 51 through the air/water supply passages 52. If the valve 54 is switched to close the branch at the air pump 40 side and opens the branch at the water pump 56 side, then the water is supplied from the water pump 56 to the air chamber 51 through the air/water supply passages 52.

A rubber sheet 30 is arranged between the carrier 24 and the head body 22. The rubber sheet 30 is a disc with a uniform thickness. The rubber sheet is fixed to the bottom of the head body 22 with support of an annular stopper 58. The rubber sheet is divided into a central part 30A and an outer peripheral part 30B with the stopper 58 being a boundary. The central part 30A of the rubber sheet 30 functions as an air bag which presses the carrier 24, and the outer peripheral part 30B functions as an air bag which presses the polished surface adjustment ring 28.

A space 60 is formed below the head body 22, and the space 60 is sealed by the central part 30A of the rubber sheet 30 and the stopper 58. The air supply passage 36 communicates with the space 60. When the compressed air is supplied into the space 60 through the air supply passage 36, the central part 30A of the rubber sheet 30 is elastically deformed under the air pressure to press the top of the carrier 24. Thus, the wafer is pressed against the polishing cloth 16. Adjusting the air pressure with the regulator 38B controls the pressure force (polishing pressure) of the wafer 50.

The cylindrical guide ring 26 is coaxially arranged below the head body 22. The guide ring 26 is fixed to the head body 22 through the rubber sheet 30. The polished surface adjustment ring 28 is arranged between the guide ring 26 and the carrier 24. A retainer ring 62 is attached to the inner periphery of the lower part of the polished surface adjusting ring 28.

The retainer ring 62 is made of a softer material such as rubber and resin than the polished surface adjustment ring 28. For this reason, the wafer 50 is not damaged when the wafer 50 comes into contact with the retainer ring 62.

An annular space 64 is formed at the lower outer periphery of the head body 22, and the space 64 is tightly closed by the head body 22, the outer periphery 30B of the rubber sheet 30, or the like. The air supply passage 34 connects with the space 64. When the compressed air is supplied into the space 64 through the air passage 34, the outer peripheral part 30B of the rubber sheet 30 is elastically deformed under the air pressure to press the annular top of the polished surface adjusting ring 28. This presses the annular bottom (contact surface) 29 of the polished surface adjusting ring 28 against the polishing cloth 16. Adjusting the air pressure with the regulator 38A controls the pressure force of the polished surface adjustment ring 28.

The wafer holding head 14 is provided with a stock removal detector which detects a stock removal of the wafer 50 in polishing. The stock removal detector consists of a sensor 70, which is composed of a core 66 and a bobbin 68, and non-contact sensors 72. A CPU (see FIG. 3) 74 is provided outside the wafer holding head 14, and the CPU 74 calculates a detected value which is detected by the sensors 70, 72.

In FIG. 2, the sensor 70 is a differential transformer, and the bobbin 68 of the differential transformer is attached to the end of an arm 76 which extends toward a rotary shaft of the wafer holding head 14 from the inner surface of the polished surface adjustment ring 28. The core 66 of the sensor 70 is provided at such a position that a central axis of the core 66 is coaxial with the rotary shaft of the wafer holding head 14. The sensor 70 detects a vertical movement amount of the carrier 24 with respect to the contact surface 29 of the polished surface adjustment ring 28, and also detects a collapsing position of the polished surface adjustment ring 28 with respect to the surface of the polishing cloth 16. A groove 78 is formed in the carrier 24, and the arm 76 is inserted into the groove 78.

The sensor 70 is able to roughly detect the stock removal of the wafer 50. In this embodiment, however, the detected value detected by the sensor 70 is corrected by the detected values detected by the sensors 72 so as to obtain the correct stock removal of the wafer 50.

The sensor 72 is a non-contact sensor such as a capacity sensor, a detecting surface 72A of the sensor 72 is flush with the bottom of the porous board 42. The detecting surface 72 detects the distance from the detecting surface 72A to the top of the wafer 50 to thereby detect a variable in thickness of the pressure air layer (the air chamber 51)

Figure 3:
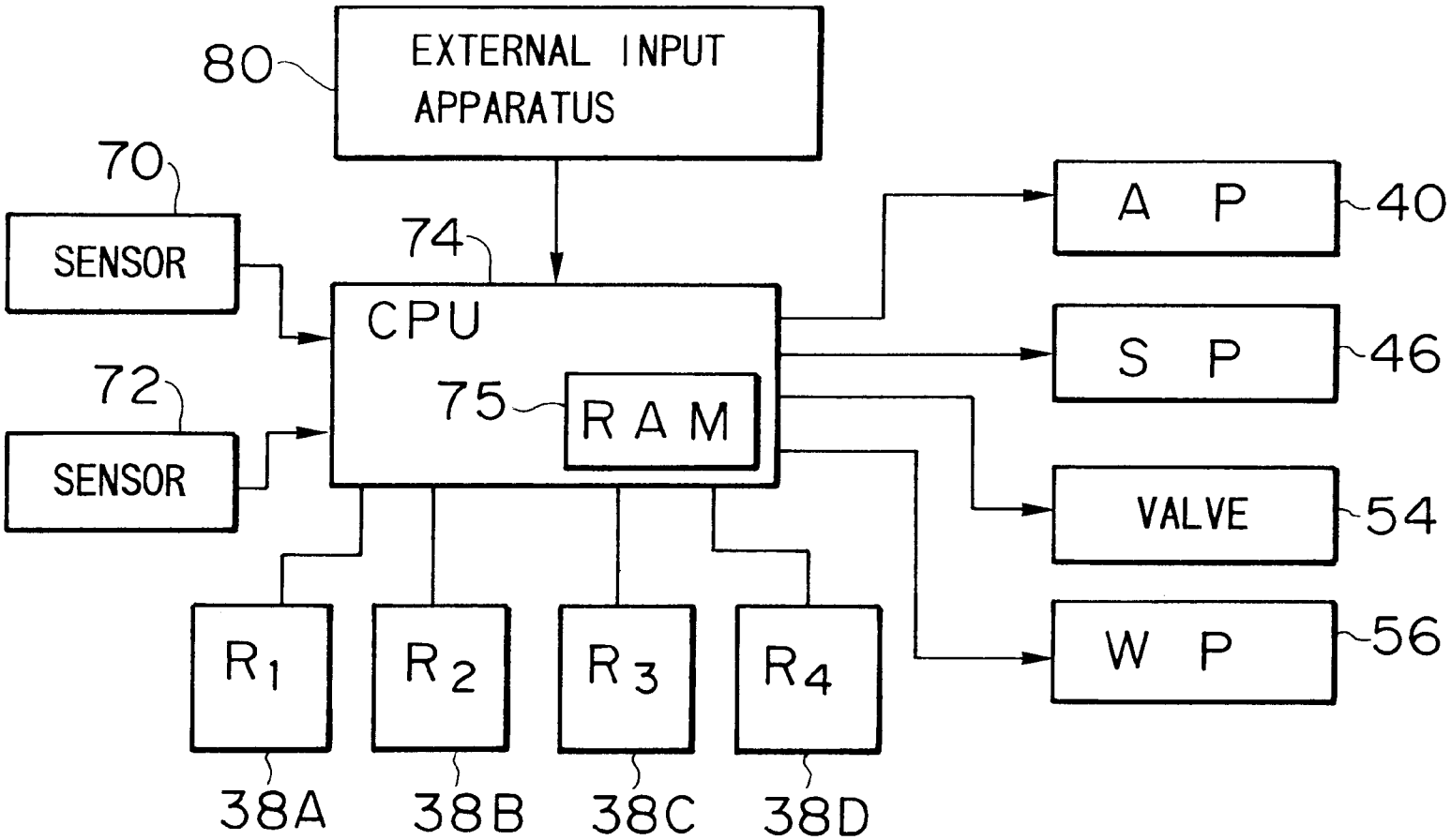
FIG. 3 is a block diagram illustrating the control system in the wafer polishing apparatus in FIG. 1.

The CPU 74 in FIG. 3, which generalizes and controls the wafer polishing apparatus, adds the variable in thickness of the pressure air layer detected by the sensors 72 to the movement amount of the carrier 24 detected by the sensor 70. In other words, the CPU 74 calculates the stock removal of the wafer 50 from the variable and the movement amount with respect to a previously-stored reference value. For instance, if the movement amount detected by the sensor 70 is T1 and the average of the variables detected by the sensors 72 is T2, the stock removal of the wafer 50 is calculated in accordance with the equation T1+T2. If the movement amount detected by the sensor 70 is T1 and the average of the variables detected by the sensors 72 is 0, the stock removal of the wafer 50 is calculated in accordance with the equation T1−0. If the movement amount detected by the sensor 70 is T1 and the average of the variables detected by the sensors is −T2, the stock removal of the wafer 50 is calculated in accordance with the equation T1−T2. According to this embodiment, since the stock removal is calculated from the variable and the movement amount detected by the sensors 70, 72, it is possible to detect the stock removal of the wafer 50 correctly. Moreover, since the thickness of the wafer subject for polishing is found previously, it is also possible to detect a relation between the polished surface of the wafer 50 and a collapsing position of the polished surface adjustment ring 28 with respect to the polishing cloth 16. Thus, the pressure force of the polished surface adjustment ring 28 can be adjusted correctly.

Prior to an explanation of the operation of the wafer polishing apparatus 10, a description will be given of a pre-setting work for setting the pressure force of the polished surface adjustment ring 28 at a proper value.

First, the polished surface adjustment ring 28 comes into contact with the flat surface of the reference member, and the wafer 50 is pressed against the flat surface of the reference member through the pressure air layer. At this time, the reference position of the polished surface adjustment ring 28 with respect to the carrier 24 is obtained in the state wherein the position of the polished surface adjustment ring 28 with respect to the carrier 24, which is detected by the sensor 70, is 0.

Next, the polishing state of the wafer 50 is confirmed when the polished surface adjustment ring 28 is pressed against the polishing cloth 16 under a preset pressure force, thus acquiring a collapsing position of the polished surface adjustment ring 28 with respect to the polishing cloth 16 when the wafer 50 is uniformly polished.

Figure 4:
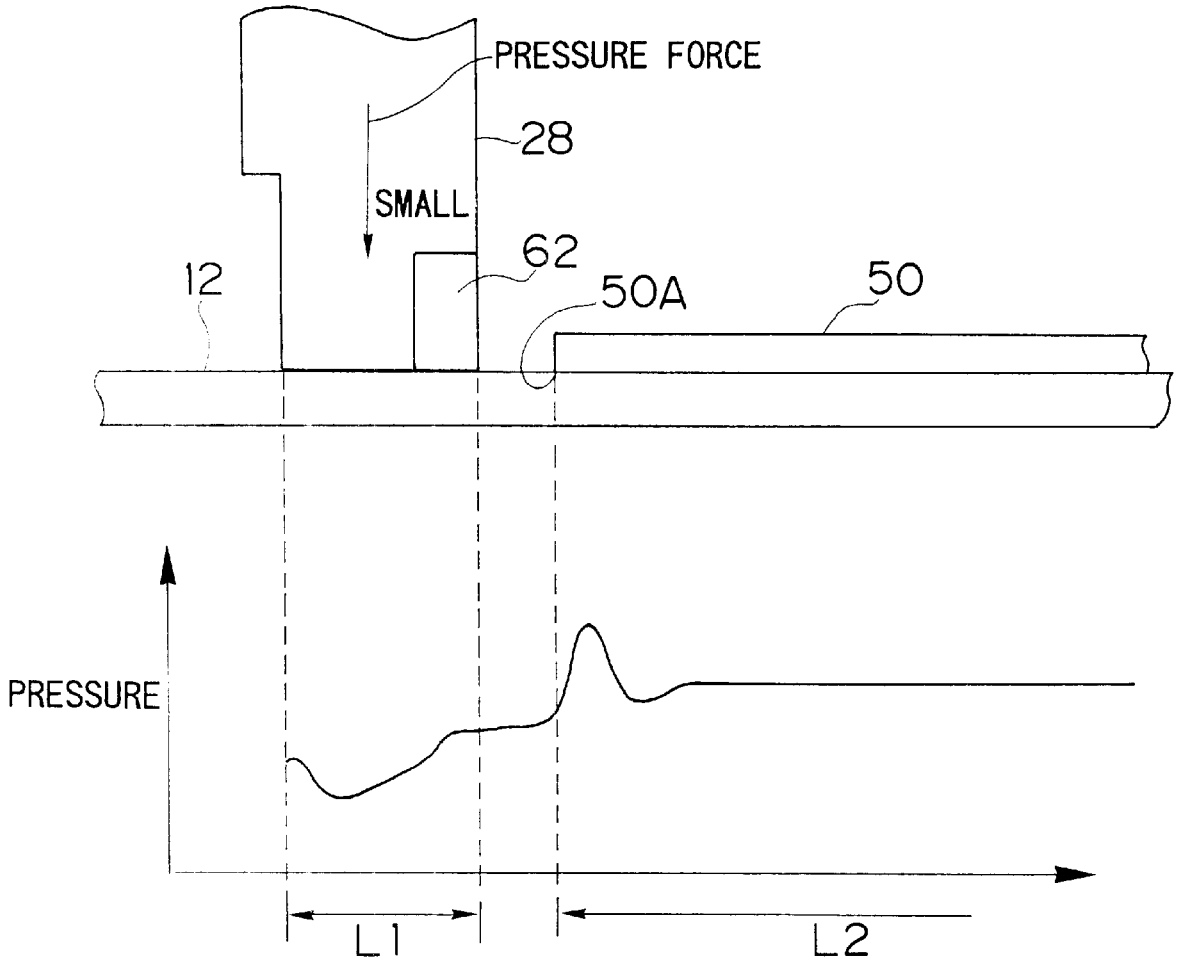
FIG. 4 is a view of assistance in explaining the polishing pressure which is applied to the wafer from the polishing cloth when the pressure force of the polished surface adjustment ring is small.
Figure 5:
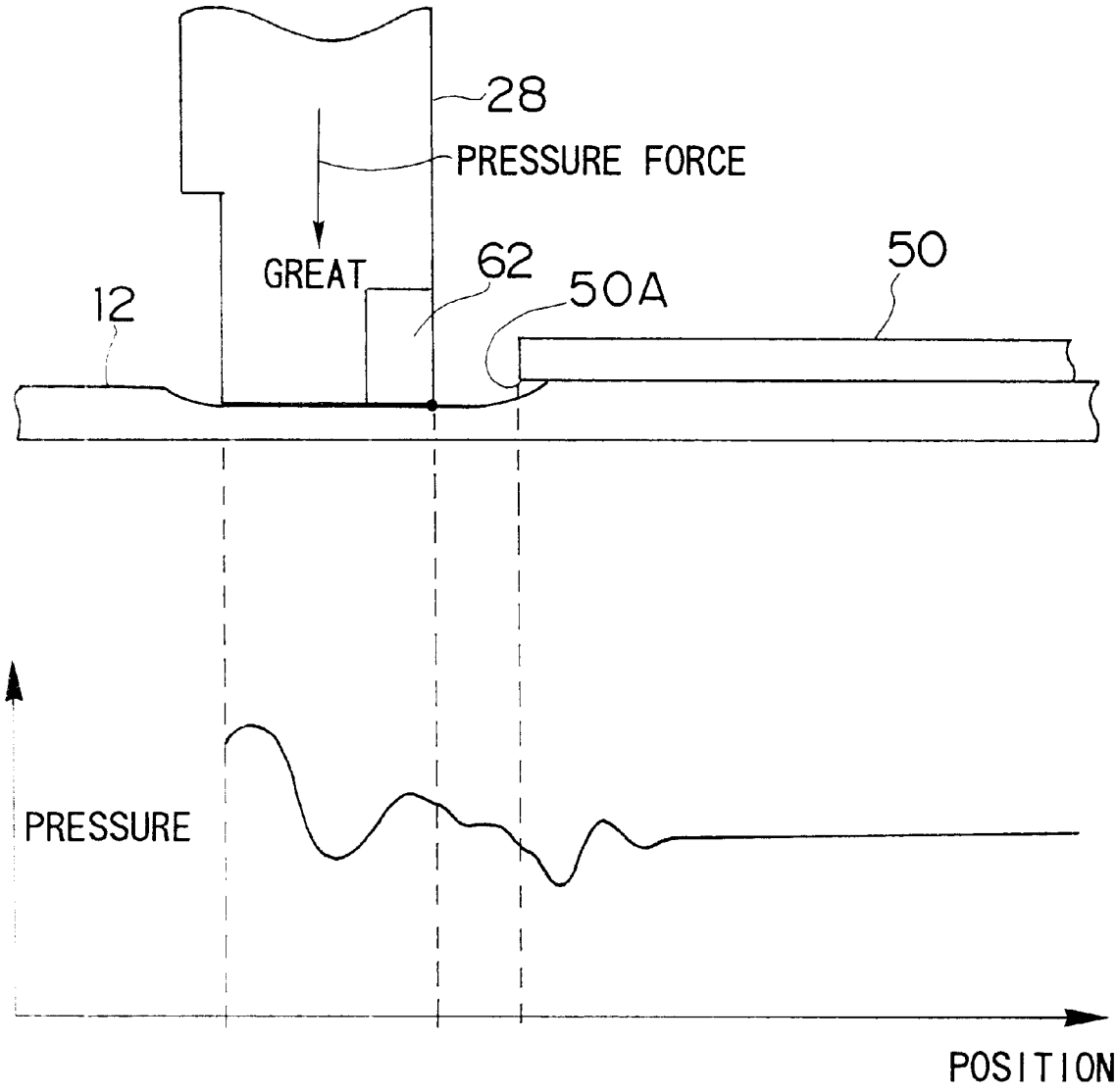
FIG. 5 is a view of assistance in explaining the polishing pressure which is applied to the wafer from the polishing cloth when the pressure force of the polished surface adjustment ring is great.
Figure 6:
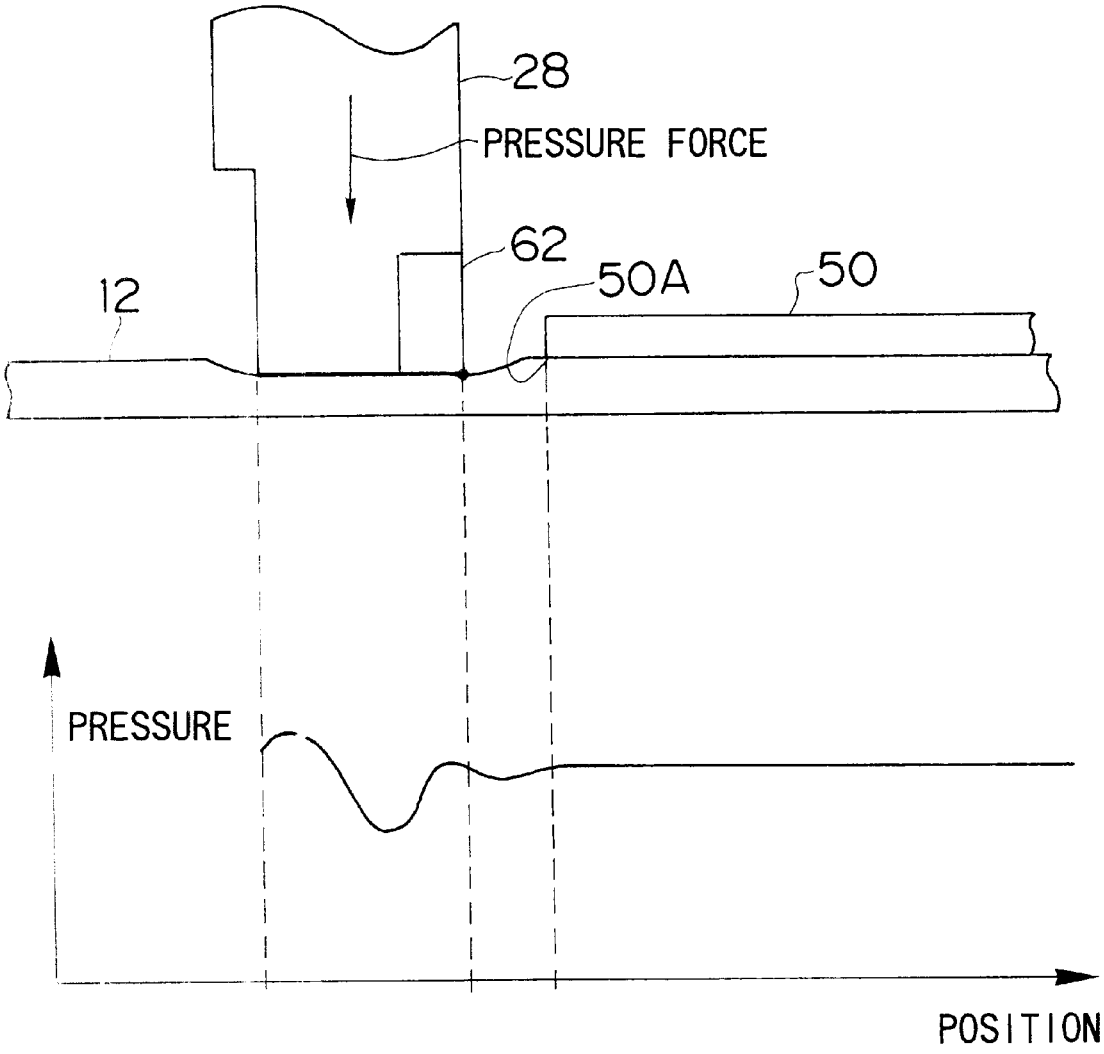
FIG. 6 is a view of assistance in explaining the polishing pressure which is applied to the wafer from the polishing cloth when the pressure force of the polished surface adjustment ring is set at a proper value.

FIGS. 4–6 are views of assistance in explaining a polishing pressure which is applied from the polishing cloth 16 to the wafer 50 when the collapsing position of the polished surface adjustment ring 28 with respect to the polishing cloth 16 is changed.

FIG. 4 shows the polishing pressure when the collapsing position of the polished surface adjustment ring 28 is substantially on the surface of the polishing cloth 16, in other words, when the pressure force is small. Due to the small pressure force of the polished surface adjustment ring 28 against the polishing cloth 16, the polishing cloth 16 rises at the periphery 50A of the wafer 50, and the periphery 50A of the wafer 50 is polished much more than the other parts.

FIG. 5 shows the polishing pressure when the collapsing position of the polished surface adjustment ring 28 is deep into the polishing cloth 16, in other words, when the pressure force is great. In this case, due to the excessive pressure force of the polished surface adjustment ring 28 against the polishing cloth 16, the polishing cloth 16 does not come into contact with the periphery 50A of the wafer 50, and the periphery 50A of the wafer 50 is not polished.

FIG. 6 shows such a collapsing position of the polished surface adjustment ring 28 as to cause the polishing cloth 16 to come into contact with the periphery 50A of the wafer 50 and prevent the polishing cloth 16 from rising at the periphery 50A of the wafer 50. According to this collapsing position, the polishing pressure which is applied from the polishing cloth 16 to the wafer 50 is uniform, and the entire surface of the wafer 50 is uniformly polished. At this time, the air pressure is read from the regulator 38A, and the air pressure is stored in RAM 75 of the CPU 74. To polish the wafer 50, the air pressure is read from the RAM 75, and the CPU 74 controls the regulator 38A so as to maintain the air pressure. The presetting work is completed.

A description will be given of the operation of the wafer polishing apparatus 10 which is constructed in the above-mentioned manner.

First, the wafer holding head 14 is moved up, and then the suction pump 46 is run to absorb the wafer 50 subject for polishing to the porous board 42.

Next, the wafer holding head 14 is moved down and stopped at a position where the contact surface 29 of the polished surface adjustment ring 28 of the wafer holding head 14 contacts the polishing cloth 16. Then, the suction pump 46 is stopped to release the absorption of the wafer 50, and the wafer 50 is placed on the polishing cloth 16.

Then, the air pump 40 is run to supply the compressed air into the air chamber 51 through the air supply passage 48, thereby forming a pressure air layer in the air chamber 51.

Then, the compressed air is supplied from the air pump 40 to the space 60 through the air supply passage 36, and the central part 30A of the rubber sheet 30 is elastically deformed under the inner air pressure to press the carrier 24. The wafer 50 is pressed against the polishing cloth 16 through the pressure air layer. The regulator 38B adjusts the air pressure to thereby control the inner air pressure at desired air pressure, so that the pressure force (polishing pressure) of the wafer 50 against the polishing cloth 16 can be uniform.

The compressed air is supplied from the air pump 40 into the space 64 through the air supply passage 34, and the outer peripheral part 30B of the rubber sheet 30 is elastically deformed under the inner air pressure to press the polished surface adjustment ring 28. Thus, the bottoms of the polished surface adjustment ring 28 and the retainer ring 62 are pressed against the polishing cloth 16.

The regulator 38A adjusts the air pressure at an air pressure stored in the RAM 75 of the CPU 74, and the collapsing position of the polished surface adjustment ring 28 is set so that the polishing pressure which is applied from the polishing cloth 16 to the wafer 50 can be uniform (see FIG. 6). The regulator 38A keeps the air pressure constant.

The polishing pressure is set through the external input apparatus 80 in FIG. 3. Then, the turn table 12 and the wafer holding head 14 are rotated to start polishing the wafer 50. The external input apparatus 80 can set the polishing pressure just before polishing or in advance.

The sensors 70, 72 and the CPU 74 calculate the stock removal of the wafer 50 during the polishing. When the calculated stock removal reaches a preset target value, the CPU 74 outputs a polishing end signal to stop the wafer polishing apparatus, and the polishing of the first wafer 50 is completed. The above-described steps are repeated to polish the subsequent wafers 50.

As stated above, in this embodiment, the wafer 50 is polished in the state wherein the collapsing position of the polished surface adjustment ring 28 is set so that the polishing pressure which is applied the polishing cloth 16 to the wafer 50 can be constant. For this reason, the entire surface of the wafer 50 can be polished uniformly.

An optimum collapsing position of the polished surface adjustment ring 28 varies according to the hardness of the polishing cloth 16. Specifically, in the case of the hard polishing cloth 16 made of polyurethane, the collapsing position of the polished surface adjustment ring 28 is set equal to the height of the polished surface of the wafer 50. To the contrary, in the case of the soft polishing cloth 16 made of polyurethane and sponge, the collapsing position of the polished surface adjustment ring 28 is set closer to the turn table 12 than to the height of the polished surface of the wafer 50. Specifically, the polished surface adjustment ring 28 is pressed into the polishing cloth 16. The soft polishing cloth 16 rises at the edge of the wafer 50 higher than the hard polishing cloth 16.

Figure 7:
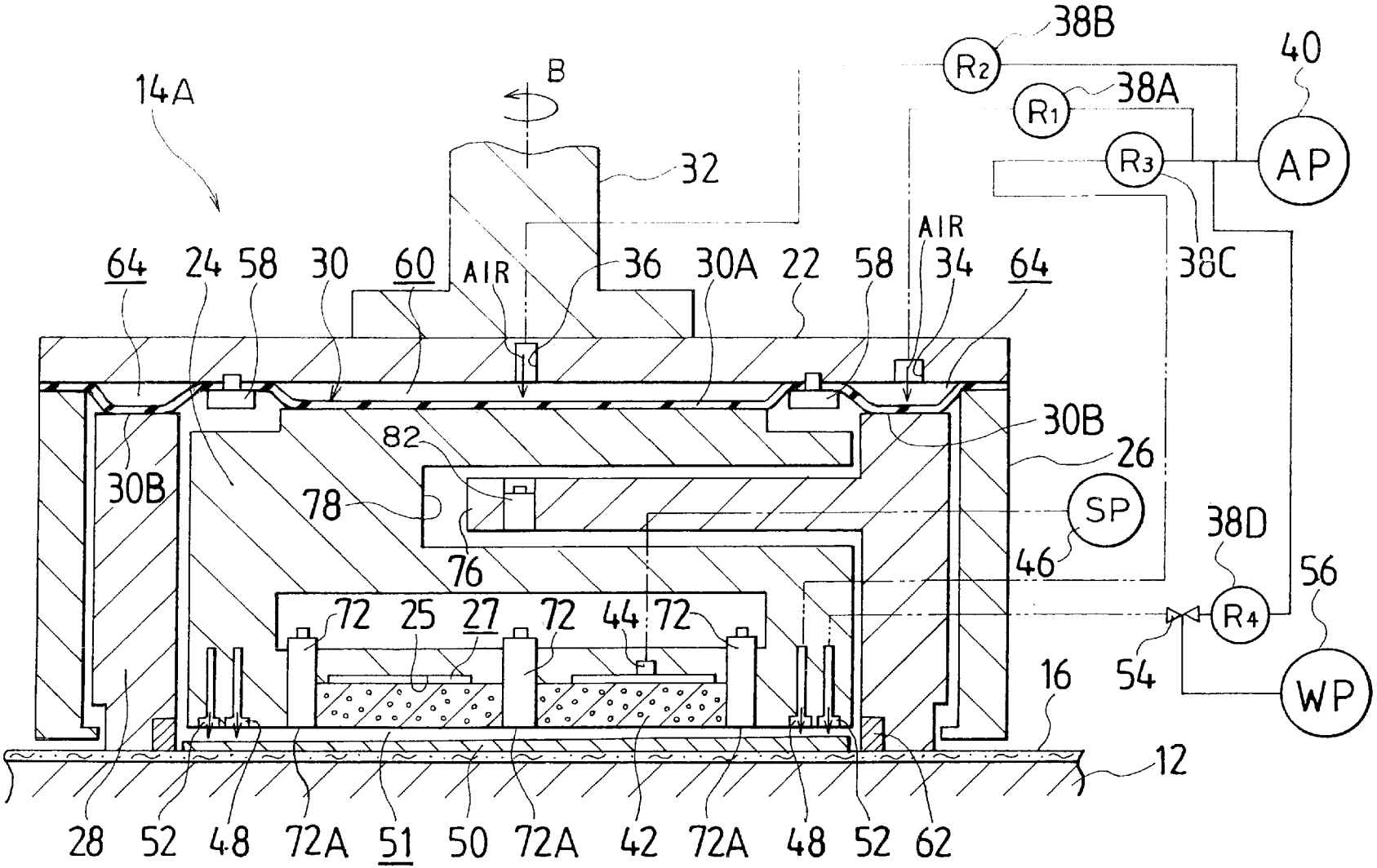
FIG. 7 is a sectional view illustrating the second embodiment of the wafer holding head.

FIG. 7 is a longitudinal sectional view illustrating the second embodiment of the wafer holding head 14A. Parts similar to those of the wafer holding head 14 of the first embodiment are designated by the same reference numerals, and they will not be explained.

According to the wafer holding head 14A in FIG. 7, the capacity sensor 82 is attached to the arm 76 of the polished surface adjustment ring 28, and the capacity sensor 82 detects a relative displacement of the carrier 24 and the polished surface adjustment ring 28 to thereby detect the collapsing position of the polished surface adjustment ring 28 with respect to the polishing cloth 16. If the capacity sensor 82 in FIG. 7 is used instead of the sensor 70 (the differential transformer) in FIG. 2 as stated above, it is possible to detect the collapsing position of the polished surface adjustment ring 28 with respect to the polishing cloth 16.

Figure 8:
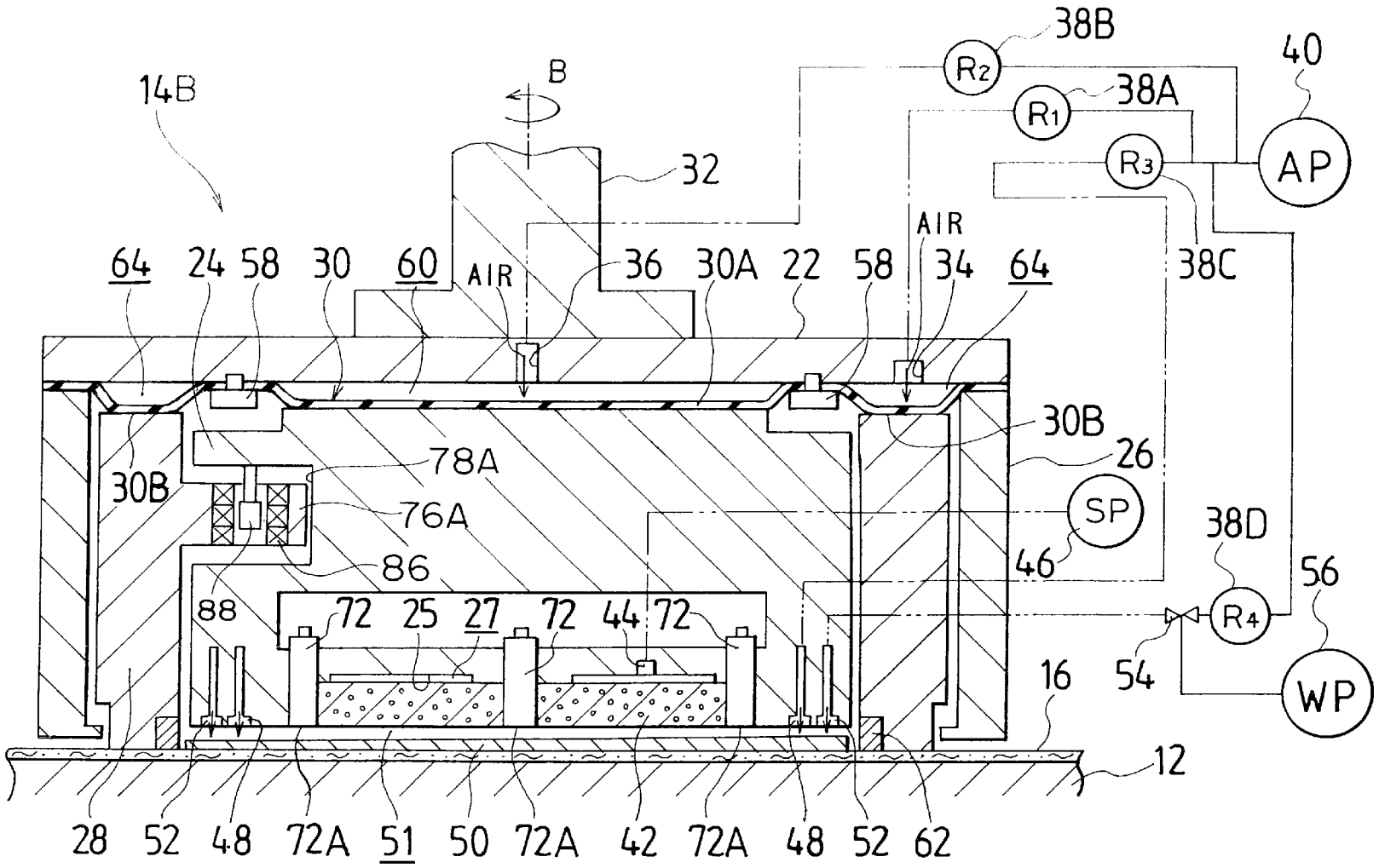
FIG. 8 is a longitudinal sectional view illustrating the third embodiment of the wafer holding head.

FIG. 8 is a longitudinal sectional view illustrating the third embodiment of the wafer holding head 14B. Parts similar to those of the wafer holding head 14 of the first embodiment in FIG. 2 are designated by the same reference numerals, and they will not be explained.

The wafer holding head 14B in FIG. 8 is constructed in such a way that a small groove 78A is formed at the outer periphery of the carrier 24 and a differential transformer 84 is arranged in the groove 78A, so that the wafer holding head 14B can detect the relative displacement of the carrier 24 and the polished surface adjustment ring 28. In the differential transformer 84, a bobbin 86 is provided at the end of a relatively-short arm 76A which projects from the inner surface of the polished surface adjustment ring 28, and a core 88 is provided at the carrier 24 side. If the differential transformer 84 is provided at the outer periphery of the carrier 24 as stated above, it is possible to detect the collapsing position of the polished surface adjustment ring 28 with respect to the polishing cloth 16.

Figure 9:
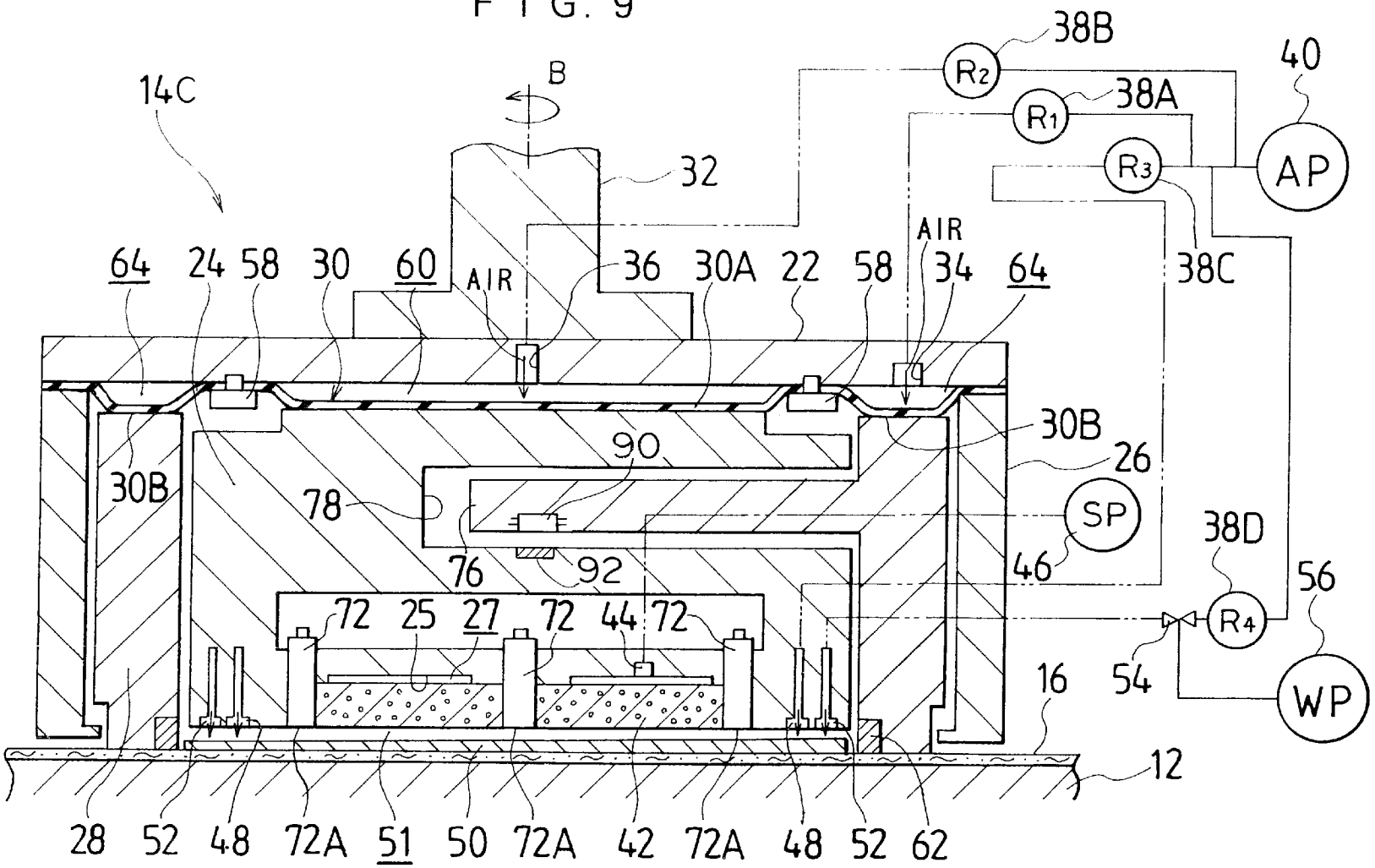
FIG. 9 is a sectional view illustrating the fourth embodiment of the wafer holding head.

FIG. 9 is a longitudinal sectional view illustrating the fourth embodiment of a wafer holding head 14C. Parts similar to those of the wafer holding head 14 of the first embodiment in FIG. 2 are designated by the same reference numerals, and they will not be explained.

The wafer holding head 14C in FIG. 9 is constructed in such a way that a Hall sensor (a magnet sensor) 90 is attached to the arm 76 of the polished surface adjustment ring 28 and a magnet 92 is attached to the surface of the carrier 24 at the opposite side of the Hall sensor 90. The wafer holding head 14C detects the relative displacement of the carrier 24 and the polished surface adjustment ring 28 in accordance with a Hall voltage output from the Hall sensor 90, thereby detecting the collapsing position of the polished surface adjustment ring 28 with respect to the polishing cloth 16. If the Hall sensor 90 in FIG. 9 is used instead of the sensor 70 (the differential transformer) in FIG. 2 as stated above, it is possible to detect the collapsing position of the polished surface adjustment ring 28 with respect to the polishing cloth 16.

In the first, second, third and fourth embodiments, the differential transformer, the capacity sensor and the Hall sensor are used for the position detecting means, but the present invention should not be restricted to them. For instance, a non-contact sensor such as an eddy current sensor, an ultrasonic sensor, and a laser sensor (a light wave interference apparatus) may be used, and a linear scale composed of a scale and a photosensor may also be used. If the scale is provided at the polished surface adjustment ring 28 and the photosensor which reads the scale is provided at the carrier 24, the collapsing position of the polished surface adjustment ring 28 can be detected.

Figure 10:
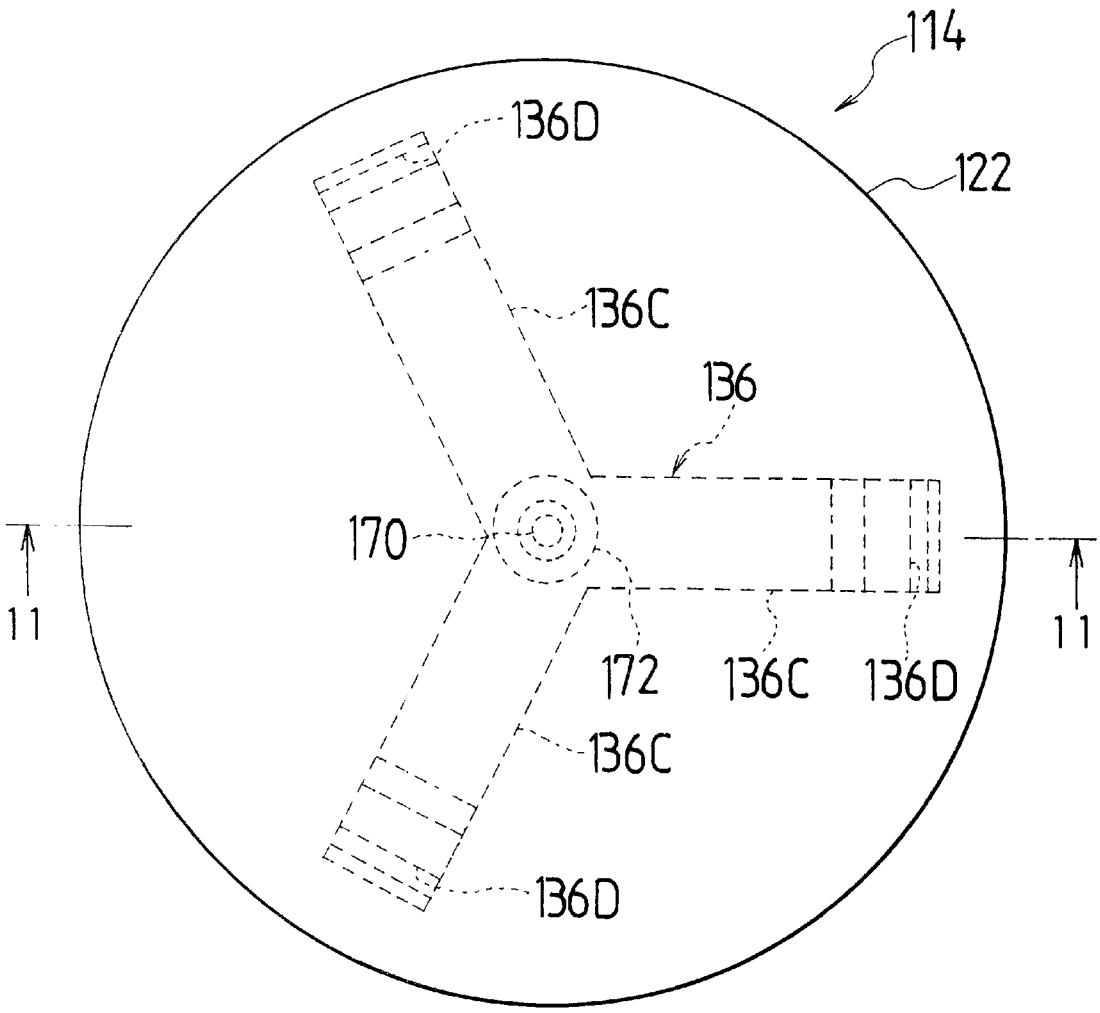
FIG. 10 is a plan view illustrating the fifth embodiment of the wafer holding head.
Figure 11:
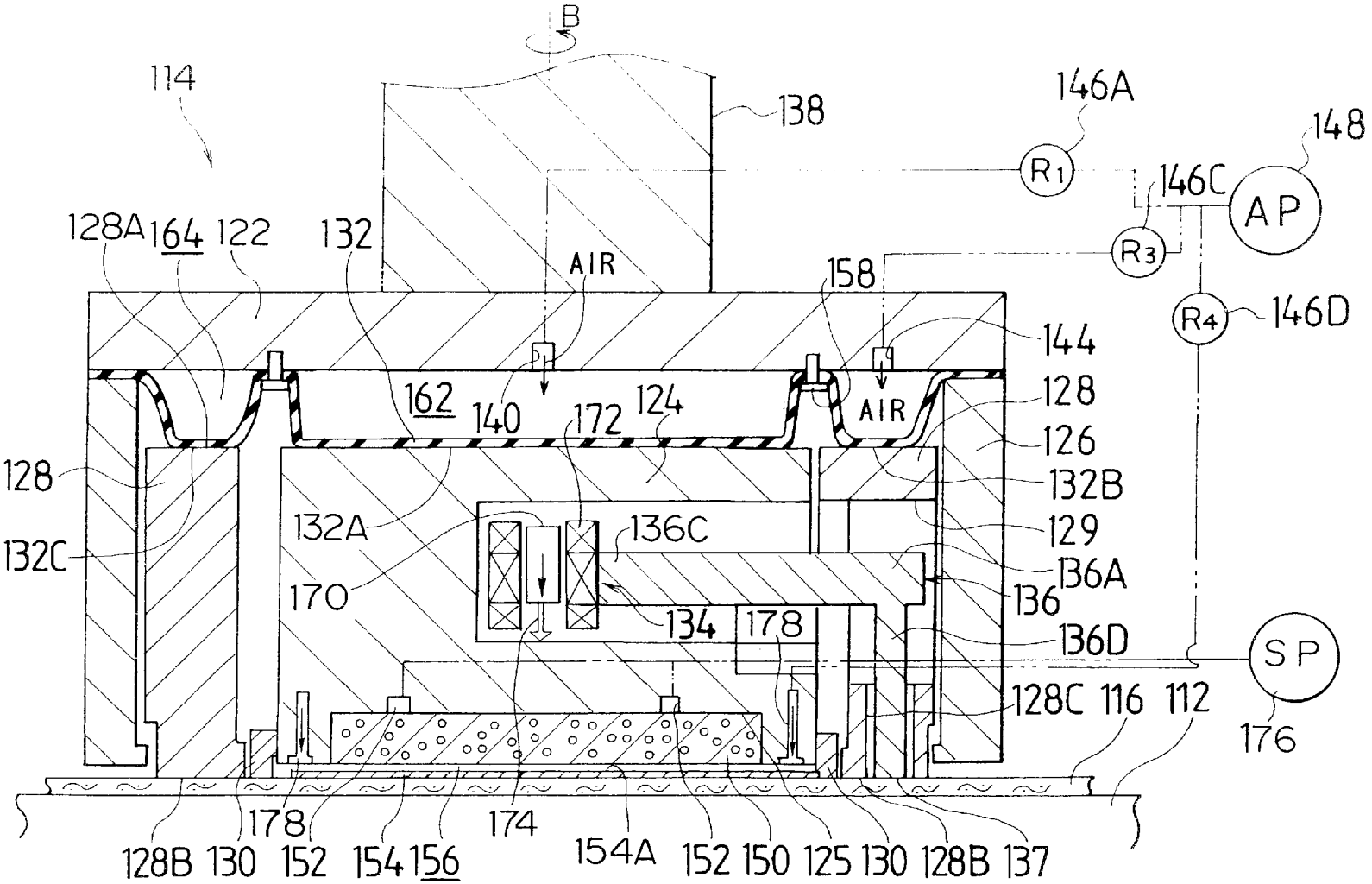
FIG. 11 is a longitudinal sectional view illustrating the fifth embodiment of the wafer holding head.

FIG. 10 is a plan view illustrating the fifth embodiment of a wafer holding head 114, and FIG. 11 is a longitudinal sectional view taken along line 11—11 of FIG. 10.

The wafer holding head 114 in FIG. 11 is comprised mainly of a head body 122, a carrier 124, a guide ring 126, a polished surface adjustment ring 128, a retainer ring 130, a rubber sheet 132, a differential transformer 134 and a pressing member 136.

The head body 122 is disc-shaped, and a rotary shaft 238 connects to the top of the head body 122. The head body 122 is rotated in the direction of an arrow B by a motor (not shown) which connects to the rotary shaft 138. Air supply passages 140, 144 are formed in the head body 122. The air supply passage 140 extends to the outside of the wafer holding head 114 as indicated by long and two short alternate lines in FIG. 11. The air supply passage 140 connects to an air pump (AP) 148 via a regulator (R) 146A. The air supply passage 144 also extends to the outside of the holding head 114. The air supply passage 144 connects to the air pump 148 via a regulator 146C.

The carrier 124 is shaped like a column, and it is coaxially arranged below the head body 122. A concave 125 is formed at the bottom of the carrier 124, and the concave 125 contains a permeable porous board 150. The porous board 150 connects with air passages 152 which are formed in the carrier 124. As indicated by long and two short alternate lines in FIG. 11, the air passages 152 extend to the outside of the holding head 114, and they connect to a suction pump (SP) 176. Driving the suction pump 176 causes the wafer 154 to be absorbed to the porous board 150. The porous board 150 has a number of vent holes therein, and it is made of, for example, a sintered body of ceramic material.

A number of air supply passages 178 (FIG. 11 shows two of them) are formed at the bottom of the carrier 124 at the periphery of the porous board 150. The air supply passages 178 extend to the outside of the carrier 124, and connect to the air pump 148 through a regulator 146D. Driving the air pump 148 causes the compressed air to be jetted from the air pump 148 into a space 156 through the air supply passages 178. This forms a pressure air layer in the space 156, through which the pressure force is transmitted from the carrier 124 to the wafer 154. The wafer 154 is polished while it is pressed against the polishing cloth by the pressure force transmitted through the pressure air layer.

On the other hand, a disc-shaped rubber sheet 132 with uniform thickness is arranged between the head body 122 and the carrier 124. The rubber sheet 132 is fixed to the bottom of the head body 122 with support of annular stopper 158. The rubber sheet 132 is divided into a central part 132A and an outer peripheral part 132B with the stopper 158 being a boundary. The central part 132A functions as an air bag which presses the carrier 124, and the outer peripheral part 132B functions as an air bag which presses the polished surface adjustment ring 128.

The air supply passage 140 connects with the air bag 162 which is specified by the central part 132A of the rubber sheet 132. When the compressed air is supplied to the air bag 162 through the air supply passage 140, the central part 132A of the rubber sheet 132 is elastically deformed under the air pressure to press the top of the carrier 124. This presses the wafer 154 against the polishing cloth 116. Adjusting the air pressure with the regulator 146A controls the pressure force (the polishing pressure) of the wafer 154.

The guide ring 126 is shaped like a cylinder, and it is coaxially arranged below the head body 122. The guide ring 126 is fixed to the head body 122 via the rubber sheet 132. A polished surface adjustment ring 128 is arranged between the guide ring 126 and the carrier 124. A retainer ring 130 is attached to the outer periphery of the carrier 124 within the polished surface adjustment ring 128, and the retainer ring 130 prevents the wafer 154 from springing out.

An annular air bag 164 is specified by the outer peripheral part 132B of the rubber sheet 132, and the stopper 158 is formed at the lower peripheral part of the head body 122. The air bag 164 connects to the air supply passages 144. The supply of the compressed air to the air bag 164 through the air supply passage 144 elastically deforms the outer peripheral part 132B of the rubber sheet 132 under the air pressure to thereby press an annular top surface 128A of the polished surface adjustment ring 128. An annular bottom surface (contact surface) 128B of the polished surface adjustment ring 128 is pressed against the polishing cloth 116. Adjusting the air pressure with the regulator 146C controls the pressure force of the polished surface adjustment ring 128.

The pressing member 136 is arranged between the carrier 124 and the polished surface adjustment ring 128. The pressing member 136 consists of bodies 136A, support arms 136C, and legs 136D. The three support arms 136C and the three legs 136D of the pressing member 136 are formed as a unit at regular intervals as indicated by dotted lines in FIG. 10. The number of legs 136D is not restricted to three, but it may be cylindrical in a manner to cover the circumference of the carrier 124.

The body 136A of the pressing member 136 in FIG. 11 is arranged in an opening 129 which is formed in the polished surface adjustment ring 128. The leg 136D of the pressing member 136 is arranged in a hole 28C formed in the polished surface adjustment ring 128. The surface of the polishing cloth 116, which is in contact with bottom surfaces 137 of the legs 136D, is flattened by the contact surface 128B of the polished surface adjustment ring 128, and this prevents the vertical vibration of the pressing member 136 due to the unevenness of the polishing cloth 116.

The base material of the pressing member 136 is umber, whose coefficient of thermal expansion is so small as to prevent the thermal expansion caused by the polishing heat. The bottom 137, which is pressed against the polishing cloth 116, is coated with diamond in order to prevent it from being polished by the polishing cloth 116. The bottom 137 may also be made of a material (e.g. ceramic) which is smaller in the machining rate than the wafer 154.

On the other hand, the differential transformer 134 is provided at the end of the support arm 136C of the pressing member 136, and the differential transformer 134 detects the collapsing position of the polished surface adjustment ring 128. The differential transformer 134 consists of a core 170, a bobbin 172, and a contact 174. The bobbin 172 connects to an arithmetic unit (not shown), which calculates the collapsing position in accordance with the vertical movement amount of the bobbin 172 and the core 170. The bobbin 172 is fixed to the end of the support arm 136C of the pressing member 136, and the core 170 is arranged in the bobbin 172 in such a way as to move vertically with respect to the bobbin 172. A rod (not shown) is coaxially fixed at the bottom of the core 170, and the contact 174 is fixed to the bottom end of the rod. The contact 174 is in contact with the carrier 124.

The user of the differential transformer 134 makes it possible to detect the collapsing position of the polished surface adjustment ring 128 with respect to the polishing cloth 116 by calculating the positions of the core 170 and the bobbin 172. As the polishing proceeds, the position of the carrier 124 changes with respect to the polishing cloth 116. The collapsing position of the polished surface adjustment ring 128, in other words, the air pressure applied to the polished surface adjustment ring 128 is initialized prior to polishing, and thus, the collapsing position can be fixed even if there is a change in position of the carrier 124 with respect to the polishing cloth 116.

In FIG. 11, the collapsing position is detected with the carrier 124 being a basis. When there is a change in position of the carrier 124 with respect to the polishing cloth 116, the collapsing position cannot be detected correctly. The position of the carrier 124 with respect to the polishing cloth 116, however, hardly changes according to the air pressure of the pressure air layer in the space 156. Thus, there is no problem if the collapsing position is detected with the carrier 124 being a basis.

A description will be given of the operation of the wafer holding head 114 which is constructed in the above-mentioned manner.

The wafer holding head 114 is moved up first, and the suction pump 176 is driven to absorb the wafer 154 subject for polishing to the porous board 150.

Then, the wafer holding head 114 is moved down and stopped at a position where the contact surface of the polished surface adjustment ring 128 comes into contact with the polishing cloth 116. The suction pump 176 is stopped to release the absorption of the wafer 154, and the wafer 154 is placed on the polishing cloth 116.

The air pump 148 is driven to supply the compressed air to the space 156 through the air passage 152 to thereby form a pressure air layer in the space 156. The control of the regulator 146D adjusts the supply of the compressed air and sets the pressure P of the pressure air layer. Specifically, the pressure P ($P>W/A$) is set to be higher than the pressure which is found by dividing the pressure force W of the rubber sheet 132, which presses the wafer 154 against the polishing cloth 116, by the area A of the wafer 154. This prevents the pressure air layer from colliding with the carrier 124.

The compressed air is supplied from the pump 148 to the air bag 162 through the air passage 140, and the central part 132A of the rubber sheet 132 is elastically deformed under the inner air pressure to thereby press the carrier 124. !he wafer 154 is pressed against the polishing cloth 116 through the pressure air layer. The adjustment of the air pressure with the regulator 146A controls the inner air pressure at a desired pressure and maintains a uniform pressure force of the wafer 154 against the polishing cloth 116.

At the same time, the compressed air is supplied from the air pump 148 to the air bag 164 through the air supply passage 144, and the outer peripheral part 132B of the rubber sheet 132 is elastically deformed under the inner air pressure to thereby press the polished surface adjustment ring 128. The bottoms of the polished surface adjustment ring 128 and the retainer ring 130 are pressed against the polishing cloth 116.

Then, the regulator 146C adjusts the air pressure to set the collapsing position of the polished surface adjustment ring 128 so that the polishing pressure applied to the wafer 154 by the polishing cloth 116 can be uniform. The regulator 146C keeps the air pressure constant.

Thereafter, the turntable 112 and the wafer holding head 114 are rotated to start polishing the wafer 154. The differential transformer 134 calculates the stock removal of the wafer 154 during polishing, and when the calculated stock removal of the wafer 154 reaches the preset target value, the differential transformer 134 outputs a polishing end signal to stop the wafer polishing apparatus, and the polishing of the first wafer 154 is completed. The above-described steps are repeated to polish the subsequent wafers 154.

According to the wafer holding head 114 of the fifth embodiment, the pressing member 136 is arranged outside the retainer ring 130, and this prevents the wafer 154 from colliding with the pressing member 136 during polishing. It is therefore possible to prevent the pressing member 136 from vibrating due to the collision with the wafer 154. For this reason, the stock removal of the wafer can be detected correctly.

The base material of the leg 136D of the pressing member 136, to which the bobbin 172 of the differential transformer 134 is attached, is umber whose coefficient of thermal expansion is so small as to prevent the thermal expansion caused by polishing heat. The bottom 137, which is pressed against the polishing cloth 116, is coated with diamond in order to prevent the bobbin from moving from a reference position (the position of a zero point). For this reason, the stock removal of the wafer 154 is detected correctly.

Since the bottom 137 of the pressing member 136 comes into contact with the polishing cloth 116 which is flattened by the polished surface adjustment ring 128, the pressing member 136 is prevented from vibrating vertically due to the unevenness of the polishing cloth 116. Thus, by the use of the differential transformer 134, the stock removal of the wafer 154 can be detected more correctly.

As set forth hereinabove, the wafer polishing apparatus of the present invention polishes the wafer in the state wherein the collapsing position of the polished surface adjustment ring with respect to the polishing cloth is set so that the polishing pressure, which is applied from the polishing cloth to the wafer, can be uniform. Thus, it is possible to prevent the concentration of the polishing pressure applied to the wafer from the polishing cloth, and the entire surface of the wafer can be polished uniformly.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing apparatus which presses a wafer against a rotating polishing cloth to polish a surface of said wafer, said wafer polishing apparatus comprising:

a carrier for holding said wafer and pressing said wafer against said polishing cloth;

a polished surface adjustment ring which encloses a periphery of said wafer and is pressed against said polishing cloth with said wafer;

pressing means for pressing said polished surface adjustment ring against said polishing cloth;

position detecting means for detecting a collapsing position of said polished surface adjustment ring with respect to said polishing cloth;

control means for controlling a pressure force of said pressing means to set said collapsing position detected by said position detecting means such that a polishing pressure applied to said wafer from said polishing cloth is uniform.

2. The wafer polishing apparatus as defined in claim 1, wherein said position detecting means is a differential transformer provided with a core and a bobbin.

3. The wafer polishing apparatus as defined in claim 1, wherein said position detecting means is a capacity sensor.

4. A wafer polishing apparatus which presses a wafer against a rotating polishing cloth to polish a surface of said wafer, said wafer polishing apparatus comprising:

a carrier for holding said wafer;

first pressing means for pressing said carrier against said polishing cloth;

pressure air layer forming means for forming a pressure air layer between said carrier and said wafer and transmitting a pressure force from said first pressing means to said wafer through said pressure air layer;

a retainer ring provided outside said carrier and preventing said wafer from springing out of said carrier;

a polished surface adjustment ring provided outside said retainer ring and said polished surface adjustment ring contacting said polishing cloth and causing said polishing cloth to contact said wafer;

second pressing means for pressing said polished surface adjustment ring against said polishing cloth;

position detecting means for detecting a collapsing position of said polished surface adjustment ring with respect to said polishing cloth;

control means for controlling the pressure force of said second pressing means to set said collapsing position detected by said position detecting means such that a polishing pressure applied to said wafer from said polishing cloth is uniform.

5. The wafer polishing apparatus as defined in claim 4, wherein said position detecting means is a differential transformer provided with a core and a bobbin.

6. The wafer polishing apparatus as defined in claim 4, wherein said position detecting means is a capacity sensor.

7. The wafer polishing apparatus as defined in claim 4, wherein said retainer ring is made of softer material than said polished surface adjustment ring.

8. A wafer polishing apparatus which presses a wafer against a rotating polishing cloth to polish a surface of said wafer, said wafer polishing apparatus comprising:

a carrier for holding said wafer;

first pressing means for pressing said carrier against said polishing cloth;

pressure air layer forming means for forming a pressure air layer between said carrier and said wafer and transmitting a pressure force from said first pressing means to said wafer through said pressure air layer;

a retainer ring provided outside said carrier and preventing said wafer from springing out of said carrier;

a polished surface adjustment ring provided outside said retainer ring and said polished surface adjustment ring contacting said polishing cloth and causing said polishing cloth to contact said wafer;

second pressing means for pressing said polished surface adjustment ring against said polishing cloth;

a pressing member provided outside said retainer ring, said pressing member coming into contact with said polishing cloth which was pressed and flattened by said polished surface adjustment ring;

position detecting means for detecting a relative displacement of said pressing member and said carrier, and detecting a collapsing position of said polished surface adjustment ring with respect to said polishing cloth according to said relative displacement;

control means for controlling the pressure force of said second pressing means to set said collapsing position detected by said position detecting means such that a polishing pressure applied to said wafer from said polishing cloth is uniform.

9. The wafer polishing apparatus as defined in claim 8, wherein said position detecting means is a differential transformer provided with a core and a bobbin.

10. The wafer polishing apparatus as defined in claim 8, wherein said position detecting means is a capacity sensor.

11. The wafer polishing apparatus as defined in claim 8, wherein said pressing member is made of material which is difficult to expand thermally, and a contact surface pressed against said polishing cloth is coated with diamond or is made of ceramic in order to be prevented from being polished by said polishing cloth.

12. The wafer polishing apparatus as defined in claim 8, wherein said retainer ring is made of softer material than said polished surface adjustment ring.

* * * * *